United States Patent [19]

Gamm

[11] Patent Number: 4,631,840

[45] Date of Patent: Dec. 30, 1986

[54] CLOSURE MEANS ATTACHMENT FOR FOOTWEAR

[75] Inventor: Robert J. Gamm, St. Louis County, Mo.

[73] Assignee: Kangaroos U.S.A., Inc., Chesterfield, Mo.

[21] Appl. No.: 779,039

[22] Filed: Sep. 23, 1985

[51] Int. Cl.[4] ..... A43B 11/00

[52] U.S. Cl. ..... 36/50; 36/51; 24/438

[58] Field of Search ..... 36/50, 51, 54; 24/438, 24/71 SK

[56] References Cited

U.S. PATENT DOCUMENTS

| | | | |
|---|---|---|---|
| 494,812 | 4/1893 | Jonas et al. | 36/51 |
| 1,862,047 | 6/1932 | Boulet et al. | 36/51 X |
| 3,122,810 | 3/1964 | Lawrence et al. | 24/438 |

FOREIGN PATENT DOCUMENTS

| | | | |
|---|---|---|---|
| 803095 | 2/1951 | Fed. Rep. of Germany | 36/51 |
| 441092 | 1/1936 | United Kingdom | 36/51 |

*Primary Examiner*—James Kee Chi

*Attorney, Agent, or Firm*—Paul M. Denk

[57] ABSTRACT

Substantially flexible means fixedly held approximate the upper edges of the quarter portions for footwear, such as of the casual or athletic shoe category, and for use for cooperating with state of the art closure means for aiding in the retention of the closure means and the shoe about the foot of its wearer, as during application. In addition, force is generated during application of the shoe, particularly when participating in athletic endeavors, that can be absorbed by the elasticity of the flexible holding means, to aid in the comfort of the shoe wearer.

3 Claims, 3 Drawing Figures

CLOSURE MEANS ATTACHMENT FOR FOOTWEAR

BACKGROUND OF THE INVENTION

This invention relates generally to a closure means for footwear, and is designed to provide an improvement in the means for attachment for such a closure means to a more flexible form of footwear, such as that utilized in the athletic or casual fields, so as to assure greater conformance of the footwear about the arch of the shoe's wearer during application.

There are a variety of closure means that have been developed in the prior art pertaining to fastening for assuring applications of shoes about the foot of a wearer. For example, the early patent to Lawrence, et al, U.S. Pat. No. 3,122,810, discloses such a fastening device, incorporating a plate like member having a series of arranged wire members that connect with the upper quarter portion of the footwear, with the plate like member further incorporating wire means for riding upon said first mentioned wire members and attaining closure for the footwear as the said member is pivoted into adjacency against the shoe's upper surface. Various additional and related types of fastening means for shoes can be seen in a variety of earlier U.S. patents, such as that to Forrester, U.S. Pat. No. 2,637,087, an additional patent to Forrester, U.S. Pat. No. 2,987,835, and the further United States patent to the same inventor, U.S. Pat. Nos. 2,969,573. Other developments in the art include Rae, U.S. Pat. No. 2,983,019; to Roda, U.S. Pat. No. 3,078,600; to Buchholz, U.S. Pat. No. 2,994,935; to Hawkins, et al, U.S. Pat. No. 3,059,351; to Mathey, U.S. Pat. No. 3,600,761. In addition, two other patents have issued relating to these type of shoe fastening devices, such as shown in the further patent to Hawkins, et al, U.S. Pat. No. 2,978,774, and the U.S. Pat. No. 3,999,256, to MacFee. Finally, a United States patent to Labecki, U.S. Pat. No. 4,104,768, upon a shoe fastening device, shows a related type of means for providing closure to footwear.

The principal object of the current invention is to provide means for providing for greater conformance of the upper quarter portions of the shoe, and the footwear closure means, as it secures about the foot of its wearer, so as to provide for a snugger embracement of the shoe about the arch of its wearer, and thereby assure greater wrap around of the shoe about the wearer's foot, while providing a more compact appearance to the closure means in its application to the shoe, while having perhaps a slightly lesser profile due to the draw of the elastic means securing the closure means to the upper approximate edges of the quarter portions of the shoe. In addition, it is submitted that greater comfort is experienced by the athlete when using the structure of this invention when embodied in athletic shoes, particulary when strenuous maneuvers are encountered during participating in an athletic event.

SUMMARY OF THE INVENTION

This invention generally relates to the improved attachment of standard closure means to the upper quarter portions of footwear, or at that location that provides variance in the opening of the shoe for ease and facility of insertion of the foot therein, and pertains to the connection of known closure means by way of substantially flexible means, preferably of the elastic type, so as to provide for more conformance in the closure of the shoe about the foot of its wearer. More specifically, the various types of closure or fastening means that may be used in conjunction with the subject matter of this development have already been previously reviewed and analyzed in the prior art. But, usually these fastening means incorporate wire arm portions that secure directly to the upper edges of the footwear quarter portions, particularly at that location where the eyestay or lacings normally would be incorporated within such a shoe. In this particular instance, these wire arm portions are secured proximate the upper edges of the footwear quarter portion, but in this particular development, through the application of elastic means, which folds around the supporting portions of the closure arms, such adds flexibility in the application of the closure means during its manipulation into a fastening position about the foot of the shoe wearer. In addition, the quarter portions, or more specifically, the reinforcing selvage or related edge portions, particularly at the upper edges of the shoe quarter portions may be formed of double liner material, fabricated either of cloth fabric, leather, or other vinyl like material, with the elastic means holding each arm of the closure means into position through looping about the respective arms, doubled over, and then securing intermediately the double layer of material forming the proximate edges of the upper quarter portions for the footwear, as previously described. Thus, greater flexibility is provided to the application and usage of the closure means in its fastening of the shoe about the foot of its wearer, and in addition, provides for better conformity of the upper shoe quarter portions, its closure means, and the elastic holding means itself, to form a more effective shapefor these shoe parts about the arch portion of the shoe wearer.

DESCRIPTION OF THE PREFERRED EMBODIMENT

Figure 1:
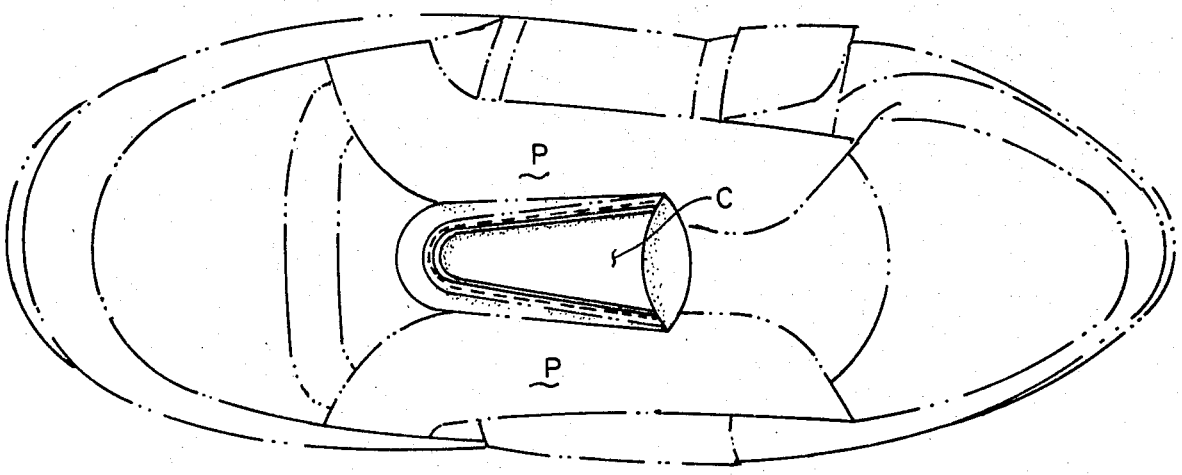
FIG. 1 provides a top view of the closure means affixed intermediate the upper quarter portions for the footwear, the latter as shown in phantom line therein.

In referring to the drawings, and in particular FIG. 1, the state of the art style of closure means C is shown appended to the upper quarter portions P of a footwear, which in this particular instance, may comprise an athletic or casual shoe.

Figure 2:
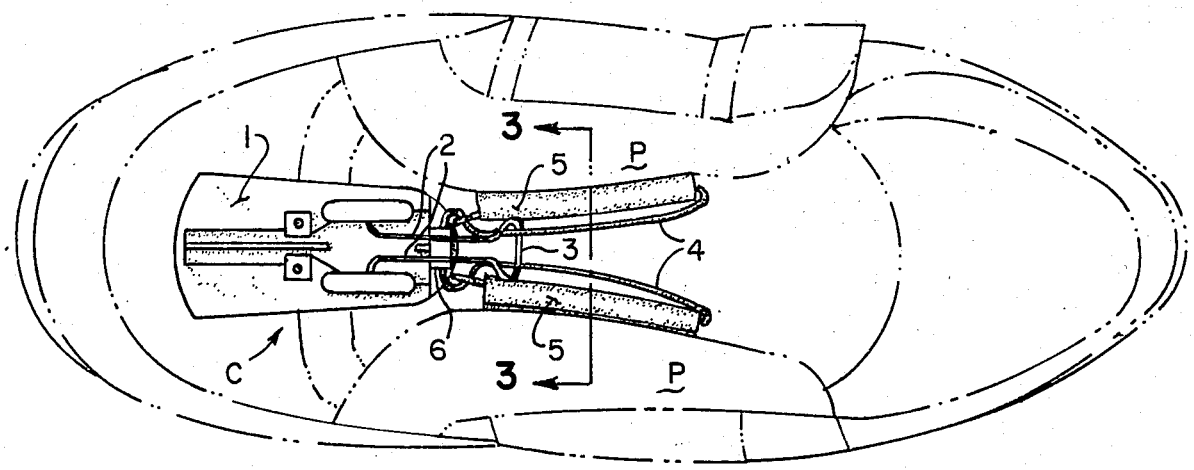
FIG. 2 provides a similar type of plan view, showing the closure means pivoted into its opened position, and clearly disclosing the resilient or elastic means used for holding the closure arms into position.

In referring to FIG. 2, the elements of this invention which are integrated into the structure of the footwear, to cooperate with the state of the art style of closure means for adhering the said means to the footwear is more accurately shown. As disclosed, the style of closure means is that which is known in the art, and incorporates a plate like member 1 which includes a substantially U-shaped interconnecting member 2 which is widened at its outer end, as at 3, for cooperating with wire arm portions 4 that are resiliently or elastically held to the upper quarter portions P for the shown footwear. These elastic means 5, comprising the improvement herein, are intended to provide more flexibility to the application of such a closure member C to footwear, and particularly that style of shoe which is subjected to greater impact, and flexible motion, such as is encountered by the athletic shoe while used within an athletic endeavor, or a casual shoe when used for frequent walking, hiking, and the like. In any event, the closure means defined herein, as a part of the state of the art, is generally described in structure, and principle of operation, in the variety of prior patents previously listed herein, but generally, as can be seen, the wire arm portions 4 have a flaring relationship at their upper ends, as noted, so that as the plate like member 1 is pivoted over into overlying and closing relationship upon the arms 4, its segment 3 has a tendency to draw the arms 4 into closer containment, thereby assuring the snuggly tension of the shoe about the foot of its wearer. This closure relationship is attained by means of pivoting the plate like member 1 over, about its pivotal boss or journal 6, until such time as the member 2, and more specifically its widened segment 3, rides up upon the arms 4, to draw them into closer containment, so that the plate like member 1 can interlock with the arms 4 for securing the closure member into its locking position. As the relationship is effected, it can be observed how the elastic means at their upper segments actually stretch to a greater dimension than the lower portions of the means, while simultaneously the upper segments have a tendency to sink or lower the closure means closer to the shoe tongue, and thereby lower its profile.

Figure 3:
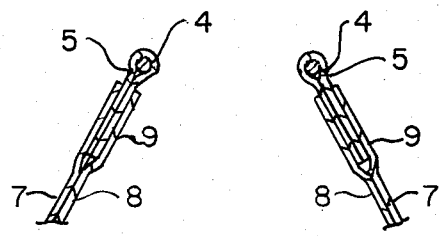
FIG. 3 provides a sectional view of the upper edges of the shoe quarter portions, and the resilient or elastic holding means securing the closure means arms into position.

As previously commented, the improvement of this development is the usage of the resilient or flexible selvages 5 adjacent substantially along the upper edges of the quarter portions P, and as can be seen in FIG. 3, these flexible members are generally formed of elastic material, are looped over about each of their respective arms 4, and then secure proximate upper edges of the quarter portions for the disclosed footwear. In the preferred embodiment, the quarter portions P will be reinforced at their upper selvages, as noted, preferably formed of a pair of liner material, as at 7 and 8, with the free ends 9 of the looped flexible material 5 being secured either by way of stitching, adhesive, or by any other means of attachment, intermediate these quarter portion liners 7 and 8, as is clearly shown. Obviously single liner quarter portions will work just as effectively as double liner material, with the addition of nylon or other material taping provided internally of the eyestay for coverage of the elastic means edges. Thus, since these elastic material strips or selvages 5 are formed of preferably such elastic material, it can be seen that greater give is provided to the closure of the footwear at this location, to facilitate the application and usage of the closure means C, and likewise, add greater conformance to the footwear at this location after it has been fastened about the arch portion of the foot of the shoe wearer. Preferably, these elastic formed materials 5 will extend for some length along the upper quarter portion of the shoe, as can be seen so clearly in FIG. 2, or perhaps the materials may be located at spaced locations, for holding each arm in place. Nevertheless, they are preferably formed of such elastic material, to provide that slight amount of give depending upon the amount of pressure generated through the closure mean during its application, with the force absorption encountered and sustained by the elastic means 5 being anywhere from a few ounces to a pound or more per inch in the pull of the members 5 as the closure means C is pivoted into its fastening position.

Variations or modifications to the subject matter of this improvement for attaching means to footwear may occur to those skilled in the art upon reviewing the subject matter of this disclosure. Such variations or modifications, if within the spirit of this invention, are intended to be encompassed within the scope of any claims to patent protection issuing upon this development. The description of the preferred embodiment set forth herein is done so for illustrative purposes only.

Having thus described the invention what is claimed and desired to be secured by Letters Patent is:

1. In a closure means attachment for footwear, incorporating a closure means, and of the type having a fastening device for holding the upper quarter portions proximate their upper edges of the footwear together and overlying the footwear tongue portion, and wherein said closure means incorporates structure means for securing the closure means to the footwear quarter portions, said structure means having a pair of wire arms cooperating with a spring means of the closure means, said spring means being of the type having pivotal movement with respect to the wire means to urge the closure means into closure, the improvement which comprises, substantially flexible means interconnecting the closure structure means to the proximate upper edges of the footwear quarter portions, said flexible means comprising elastic means, said elastic means comprising a length of elastic means and extending substantially along the length of the wire arms and also along the adjacent upper edges of the footwear quarter portions, said wire arms being secured to the elastic means and cooperating with the spring means to secure the footwear into closure and to effect conformance of its quarter portions upon the instep of any foot located within the said footwear, said quarter portions of the footwear being formed incorporating a pair of liner materials, and the edges of the elastic means attaching with the quarter portions being affixed intermediate the pair of liner materials forming each quarter portion for the footwear, whereby upon manipulation of the closure structure means into closure upon the footwear the elastic means at their upper segments stretch to a greater dimension than the lower portions of the elastic means and thereby providing for a lowering of the closure structure means closer to the footwear tongue upon its manipulation into closure.

2. The invention of claim 1 and wherein said footwear comprises an athletic shoe.

3. The invention of claim 1 and wherein said footwear comprises a casual shoe.

* * * * *